US007095019B1

(12) United States Patent
Sheehan et al.

(10) Patent No.: US 7,095,019 B1
(45) **Date of Patent: *Aug. 22, 2006**

(54) REMOTE REAGENT CHEMICAL IONIZATION SOURCE

(75) Inventors: Edward W Sheehan, Pittsburgh, PA (US); Ross C Willoughby, Pittsburgh, PA (US)

(73) Assignee: Chem-Space Associates, Inc., Pittsburgh, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/120,363

(22) Filed: May 2, 2005

Related U.S. Application Data

(63) Continuation of application No. 10/449,344, filed on May 30, 2003, now Pat. No. 6,888,132.

(51) Int. Cl.
*H01J 49/00* (2006.01)

(52) U.S. Cl. ..... 250/288; 250/281; 250/286

(58) Field of Classification Search ..... None
See application file for complete search history.

(56) References Cited

U.S. PATENT DOCUMENTS

| | | | |
|---|---|---|---|
| 4,209,696 | A | 6/1980 | Fite |
| 4,531,056 | A | 7/1985 | Labowsky et al. |
| 4,542,293 | A | 9/1985 | Fenn et al. |
| 4,546,253 | A | 10/1985 | Tsuchiya et al. |
| 4,999,492 | A | 3/1991 | Nakagawa |
| 5,192,865 | A | 3/1993 | Zhu |
| 5,412,208 | A | 5/1995 | Covey et al. |
| 5,436,446 | A | 7/1995 | Jarrell et al. |
| 5,559,326 | A | 9/1996 | Goodley et al. |
| 5,747,799 | A | 5/1998 | Franzen |
| 5,756,994 | A | 5/1998 | Bajic |
| 5,965,884 | A | 10/1999 | Laiko et al. |
| 6,060,705 | A | 5/2000 | Whitehouse et al. |
| 6,124,675 | A | 9/2000 | Bertrand et al. |
| 6,207,954 | B1 | 3/2001 | Andrien et al. |
| 6,239,428 | B1 | 5/2001 | Kunz |
| 6,534,765 | B1 | 3/2003 | Robb et al. |

(Continued)

FOREIGN PATENT DOCUMENTS

| | | |
|---|---|---|
| JP | 4215329 | 8/1992 |

(Continued)

OTHER PUBLICATIONS

Hartley, F.T. et al., "NBC detection in air and water," Micro/Nano 8, pp. 1, 2, and 8 (Dec. 2003).

(Continued)

*Primary Examiner*—Nikita Wells
*Assistant Examiner*—Zia R. Hashmi

(57) ABSTRACT

An improved ion source and portable analyzer for collecting and focusing dispersed gas-phase ions from a reagent source at atmospheric or intermediate pressure, having a remote source of reagent ions generated by direct or alternating currents, separated from a low-field sample ionization region by a stratified array of elements, each element populated with a plurality of openings, wherein DC potentials are applied to each element necessary for transferring reagent ions from the remote source into the low-field sample ionization region where the reagent ions react with neutral and/or ionic sample forming ionic species. The resulting ionic species are then introduced into the vacuum system of a mass spectrometer or ion mobility spectrometer. Embodiments of this invention are methods and devices for improving sensitivity of mass spectrometry when gas and liquid chromatographic separation techniques or probes containing samples are coupled to atmospheric and intermediate pressure photo-ionization, chemical ionization, and thermospray ionization sources.

40 Claims, 3 Drawing Sheets

U.S. PATENT DOCUMENTS

| | | | | |
|---|---|---|---|---|
| 6,610,986 | B1 | 8/2003 | Hartley | |
| 6,750,449 | B1 | 6/2004 | Marcus | |
| 6,852,969 | B1 | 2/2005 | Marcus et al. | |
| 6,888,132 | B1 * | 5/2005 | Sheehan et al. | 250/288 |
| 2005/0056775 | A1 | 3/2005 | Cody et al. | |
| 2005/0196871 | A1 | 9/2005 | Cody et al. | |

FOREIGN PATENT DOCUMENTS

| | | | |
|---|---|---|---|
| JP | 10088798 | | 4/1998 |
| WO | WO-01/33605 | A2 | 10/1999 |
| WO | WO-01/33605 | A3 | 10/1999 |
| WO | WO-99/63576 | | 12/1999 |
| WO | WO-00/08455 | | 2/2000 |
| WO | WO-00/08456 | | 2/2000 |
| WO | WO-00/08457 | | 2/2000 |
| WO | WO 2004/098743 | | 11/2004 |

OTHER PUBLICATIONS

Potjewyd, J., "Focusing of ions in atmospheric pressure gases using electrostatic fields," Ph.D. Thesis, University of Toronto (1983).

Cody,R.B., et al., "Versatile new ion source for the analysis of materials in open air under ambient conditions", Anal Chem 77, pp. 2297-2302 (2005).

McEwen, C.N., et al., "Analysis of solids, liquids, and biological tissues using solids probe introduction at atmospheric pressure . . . ", Anal Chem 77, pp. 7826-7831 (2005).

* cited by examiner

REMOTE REAGENT CHEMICAL IONIZATION SOURCE

CROSS-REFERENCE TO RELATED APPLICATIONS

This is a continuation of application Ser. No. 10/449,344, filed 2003 May 30, now U.S. Pat. No. 6,888,132, granted May 3, 2005. This application is related to application Ser. No. 08/946,290, filed Oct. 7, 1997, now U.S. Pat. No. 6,147,345, granted Nov. 14, 2000; application Ser. No. 09/877,167, filed Jun. 8, 2001, now U.S. Pat. No. 6,744,041, granted Jun. 1, 2004; application Ser. No. 10/449,147, filed May 31, 2003, now U.S. Pat. No. 6,818,889, granted Nov. 16, 2004; application Ser. No. 10/785,441, filed Feb. 23, 2004, now U.S. Pat. No. 6,878,930, granted Apr. 12, 2005; application Ser. No. 10/661,842, filed Sep. 12, 2003, application Ser. No. 10/688,021, filed Oct. 17, 2003, application Ser. No. 10/863,130, filed Jun. 7, 2004, now patent application publication No. 2004/0245458, published Dec. 9, 2004; and application Ser. No. 10/862,304, filed Jun. 7, 2004, now patent application publication No. 2005/0056776, published Mar. 27, 2005.

GOVERNMENT SUPPORT

The invention described herein was made in the course of work under a grant from the Department of Health and Human Services, Grant Number: 1 R43 RR143396-1.

BACKGROUND

1. Field of Invention

This invention relates to methods and devices for improved ionization, collection and focusing of ions generated from chemical and photo-ionization for introduction into the mass spectrometer and other gas-phase ion analyzers and detectors.

2. Description of Prior Art

The generation of ions at or near atmospheric pressure is accomplished by a variety of means; including, electrospray (ES), atmospheric pressure chemical ionization (APCI), atmospheric pressure matrix assisted laser desorption ionization (AP-MALDI), discharge ionization, $^{63}$Ni sources, inductively coupled plasma ionization, and photoionization. A general characteristic of these atmospheric or near atmospheric ionization sources is the dispersive nature of the ions once produced. Needle sources such as electrospray and APCI disperse ions radially from the axis in high electric fields emanating from needle tips. Aerosol techniques disperse ions in the radial flow of gases emanating from tubes and nebulizers. Even desorption techniques such as atmospheric pressure MALDI will disperse ions in a solid angle from a surface. The radial cross-section of many dispersive sources can be as large as 5 or 10 centimeters in diameter.

As a consequence of a wide variety of dispersive processes, efficient sampling of ions from atmospheric pressure sources to small cross-sectional targets or through small cross-sectional apertures and tubes (usually less than 1 mm) into a mass spectrometer becomes quite problematic. This is particularly amplified if the source on ions is removed from the regions directly adjacent to the aperture.

The simplest approach to sampling dispersive atmospheric sources is to position the source on axis with a sampling aperture or tube. The sampling efficiency of simple plate apertures is generally less than 1 ion in $10^4$. U.S. Pat. No. 4,209,696 (1980) to Fite discloses an electrospray source with a pinhole aperture, while U.S. Pat. No. 5,965,884 (1999) and World patent 99/63576 (1999) both to Laiko et al. discloses an atmospheric pressure MALDI source configured with a pinhole or aperture in a plate. An atmospheric pressure source discloses in Japanese patent 04215329 (1994) by Kazuaki et al. is also representative of this inefficient approach. This general approach in severely restricted by the need for precise aperture alignment and source positioning, for example, in the case of an APCI source the position of the discharge needle; and very poor sampling efficiencies.

U.S. Pat. No. 6,534,765 (2003) and World patent 01/33605 (1999) both to Robb et al. discloses a low field photoionization source developed for LC/MS applications. The use of this low field photo-ionization source has lead to some improvement in sampling efficiency from atmospheric pressure sources, but these sources also suffer from a lower concentration of reagent ions when compared to traditional APCI sources.

A wide variety of source configurations utilize conical skimmer apertures in order to improve collection efficiency over planar devices. This approach to focusing ions from atmospheric sources is limited by the acceptance angle of the electrostatic fields generated at the cone. Generally, source position relative to the cone is also critical to performance, although somewhat better than planar apertures. Conical apertures are the primary inlet geometry for commercial ICP/MS with closely coupled and axially aligned torches. Examples of conical-shaped apertures are prevalent in ES and APCI (U.S. Pat. No. 5,756,994), and ICP (U.S. Pat. No. 4,999,492) inlets. As with planar apertures, source positioning relative to the aperture is also critical to performance; and collection efficiency is quite low.

Another focusing alternative utilizes a plate lens with a large hole in front of an aperture plate or tube for transferring sample into the vacuum system. The aperture plate is generally held at a high potential difference relative to the plate lens. The configuration creates a potential well that penetrates into the source region and has a significant improvement in collection efficiency relative to the plate or cone apertures. But this configuration has a clear disadvantage in that the potential well resulting from the field penetration is not independent of ion source position, or potential. High voltage needles can diminish this well. Off-axis sources can affect the shape and collection efficiency of the well also. Optimal positions are highly dependent upon both flow (liquid and, concurrent and countercurrent gas flows) and voltages. They are reasonable well suited for small volume sources such as nanospray while larger flow sources become less efficient and problematic. Because this geometry is generally preferential over plates and cones, it is seen in most types of atmospheric source designs. We will call this approach the "Plate-Well" design which is reported with apertures as disclosed in U.S. Pat. No. 4,531,056 (1985) to Labowsky et al., U.S. Pat. No. 5,412,209 (1995) to Covey et al., and U.S. Pat. No. 5,747,799 (1998) to Franzen; and with tubes as disclosed in U.S. Pat. No. 4,542,293 (1985) to Fenn et al., U.S. Pat. No. 5,559,326 (1996) to Goodley et al., and U.S. Pat. No. 6,060,705 (2000) to Whitehouse et al.

Several embodiments of atmospheric pressure sources have incorporated grids in order to control the sampling of gas-phase ions. U.S. Pat. No. 5,436,446 (1995) to Jarrell et al. utilitized a grid that reflected lower mass ions into a collection cone and passed large particles through the grid. This modulated system was intended to allow grounded needles and collection cones or apertures, and float the grid at high alternating potentials. This device had limitations with duty cycle of ion collection in a modulating field (non-continuous sample introduction) and spatial and positioning restrictions relative to the sampling aperture. U.S. Pat. No. 6,207,954 (2001) to Andrien et al. used grids as counter electrodes for multiple corona discharge sources configured in geometries and at potentials to generated ions of opposite charge and monitor their interactions and reactions. This specialized reaction source was not configured with high field ratios across the grids and was not intended for high transmission and collection, rather for generation of very specific reactant ions. An alternative atmospheric pressure device by disclosed in Japanese patent 10088798 (1999) to Yoshiaki utilized on-axis hemispherical grids in the second stage of pressure reduction. Although the approach is similar to the present device in concept, it is severely limited by gas discharge that may occur at these low pressures if higher voltages are applied to the electrodes and the fact that most of the ions (>99%) formed at atmospheric pressure are lost at the cone-aperture from atmospheric pressure into the first pumping stage.

Grids are also commonly utilized for sampling ions from atmospheric ion sources utilized in ion mobility spectrometry (IMS). Generally, for IMS analysis ions are pulsed through grids down a drift tube to a detector as shown in U.S. Pat. No. 6,239,428 (2001) to Kunz. Great effort is made to create a planar plug of ions in order to maximize resolution of components in the mobility spectrum. These devices generally are not continuous, nor are they operated such that ions are focused into apertures or capillaries at the atmospheric-vacuum interface of mass analyzers.

SUMMARY

A preferred embodiment of the invention is the configuration of a high efficiency ionization source utilizing remote reagent ion generation coupled with a large reaction volume electro-optical well to facilitate efficient sample ionization and collection. The novelty of this device is the manner of isolation of the electric fields in the reagent ion generation region from the electric fields of the reaction or sample ionization region and the product ion-sampling region or funnel region. This is accomplished through the utilization of a perforated and laminated surface that efficiently passes reagent ions from the reagent source region to the reaction region without significant penetration of the fields from the adjacent regions.

OBJECTS AND ADVANTAGES

One object of the present invention is to increase the collection efficiency of ions and/or charged particles at a collector, or through an aperture or tube into a vacuum system, by creating a very small cross-sectional area beam of ions and/or charged particles from highly dispersed atmospheric pressure ion sources. The present invention has a significant advantage over prior art in that the use of a Laminated High Transmission Element (L-HTE) to separate reagent ion generation from product ion formation and ion focusing allows precise shaping of fields in both regions. Ions can be generated in large ion source regions without losses to walls. Droplets have longer time to evaporate and/or desorb neutrals or ions without loss from the sampling stream. Source temperatures can be lower because rapid evaporation is not required. This can prevent thermal decomposition of some labile compounds. Counter electrodes for APCI needles do not have to be the plate lens as practices with most conventional sources or even the HTE (high transmission elements, as disclosed in our own U.S. Pat. No. 6,744,041 (2004), U.S. Pat. No. 6,818,889 (2004), U.S. Pat. No. 6,878,930 (2005), and U.S. Pat. No. 6,888,132 (2005); U.S. patent application Ser. Nos. 10/661,842 (2003) al.; and U.S. patent publication 2004/0245458 and World patent publication 2004/110583); or our high transmission laminated tube as disclosed in our U.S. patent application Ser. No. 10/688,021 (2003)). The aerosol and plasma can be generated remotely and ions can be allowed to drift toward the HTE with a substantial portion of the ions passing through the HTE into a low-field or field-free regions at atmospheric or lower pressures.

Another object of the present invention is to have collection efficiency be independent of ion source position. With the present invention there is no need for precise mechanical needle alignment or positioning relative to collectors, apertures, or tubes invention. Ions generated at any position in the reaction and product ion-sampling regions are transmitted to the collector, aperture, or tube with similar efficiency. No existing technology has positional and potential independence of the source. The precise and constant geometry, and alignment of the focusing well with sampling apertures will not change with needle placement. The electrostatic fields inside the reaction, product ion-sampling, and deep-well regions (focusing side) will not change, even if they change outside (reagent ion source side).

Another object of the present invention is the independence of ion source type. This device is capable of transmission and collection of ions from any atmospheric (or near atmospheric) pressure ionization source; including, atmospheric pressure chemical ionization, inductively coupled plasma, discharge sources, $Ni^{63}$ sources, spray ionization sources, induction ionization sources and photoionization sources. The device is also capable of sampling ions of only one polarity at a time, but with extremely high efficiency.

Another object of the present invention is to efficiently collect and/or divert a flow of ions from more than one source. This can be performed in a simultaneous fashion for introduction of mass calibrants from a separate source and analytes from a different source at a different potential; conversely, it can be performed sequentially as is typical with multiplexing of multiple chromatographic streams introduced into one mass spectrometer.

Another object of the present invention is to efficiently transmit ions to more than one target position. This would have the utility of allowing part of the sample to be collected on a surface while another part of the sample is being introduced through an aperture into a mass spectrometer to be analyzed.

Another object of the present invention is to improve the efficiency of multiplexed inlets from both multiple macroscopic sources and micro-chip arrays, particularly those developed with multiple needle arrays for APCI. Position independence of this invention make it compatible with a wide variety of needle array technologies.

Another object of the present invention is to remove larger droplets and particles from aerosol sources with a counter-flow of gas to prevent contamination of deep-well lens, funnel aperture wall, apertures, inlets to tubes, vacuum components, etc.

One major advantage of the present device is the capability of generating a large excess of reagent ions in a remote region and then introducing the reagent ions into the reaction region to drive the equilibrium of the reaction far toward completion.

Another advantage of the present invention is the lack of limitations to the reaction volume. The reaction volume could literally be 100's of $cm^3$, not incurring sampling losses associated with conventional sources.

Another advantage of this source is the ability for neutrals and reagent ions to reside in the reaction region, in the presence of low electrostatic fields, for relatively long durations [even in the large volume]; allowing even reactions with very slow reaction kinetics to proceed toward completion.

Another advantage of the present device is the ability to utilize the tremendous compression capabilities of funnel-well optics to compress all ions generated in the reaction and funnel regions into a small cross-sectional area.

One of the most important advantages of the remote reagent ion source when compared to convention APCI sources is the lack of recombination losses, from, for example, stray electrons; with the extraction of reagent of one polarity ions out of a plasma and transport into the reaction region. In this device there are not recombination losses in the reaction region.

DRAWING FIGURES

REFERENCE NUMBERS IN DRAWINGS

Figure 1:
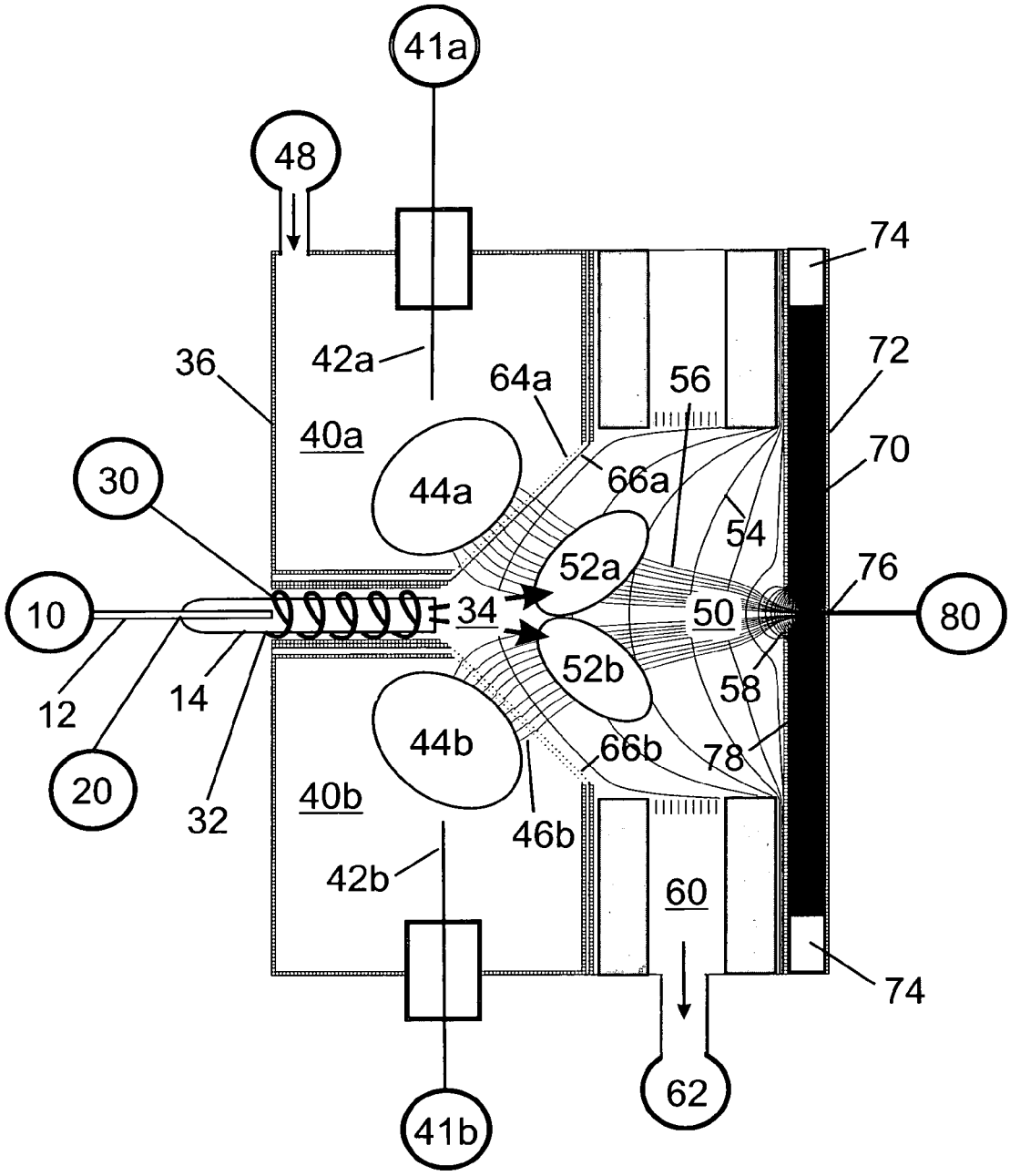
FIG. 1 is a cross-sectional illustration of a remote reagent ion generation source for atmospheric pressure chemical ionization (APCI).

10 sample source
12 sample delivery means or line
14 nebulizer
20 nebulization gas source
30 nebulizer heating supply
32 heating coils
34 sample aerosol flow
36 ion source entrance wall
40 reagent ion generation region
41 high voltage supply
42 discharge needle
44 reagent ion source region
45 lamp
46 reagent ion trajectories
48 reagent gas source
50 product ion-sampling or funnel region
52 reaction or sample ionization region
54 equipotential lines
56 sample ion trajectories
58 funnel aperture
60 exhaust outlet
62 exhaust destination
64 inner high transmission electrode
66 outer high transmission electrode
70 deep-well region
72 deep-well lens
74 deep-well insulator ring
76 exit aperture
78 funnel aperture wall
80 ion collection region

DESCRIPTION

Preferred Embodiment—FIG. 1 (Remote Atmospheric Pressure Chemical Ionization, Remote-APCI)

A preferred embodiment of the chemical ionization source of the present invention at atmospheric pressure is illustrated in FIG. 1. Sample from a sample source 10 is delivered to a nebulizer 14 by a sample delivery means 12 through an ion source entrance wall 36. This embodiment contains a heated nebulizer for nebulization and evaporation of sample streams emanating from liquid chromatographs and other liquid sample introduction devices. The liquid sample is heated, nebulized, and vaporized by the input of nebulization gas from a nebulization gas source 20 and by heat from heating coils 32 generated from a nebulizer heating supply 30. The nebulizer generates a sample aerosol flow 34 with the sample being vaporized into the gas-phase and proceeding into a reaction or sample ionization region 52.

Reagent ions are generated in a reagent ion generation region 40 by electron ionization from a discharge needle 42. The voltage applied to the discharge needle is supplied from a high voltage supply 41. Reagent gas is supplied to region 40 from a reagent gas source 48. In this preferred embodiment, reagent ions are generated in more than one region in the annular space around the sample ionization regions 52*a* and 52*b*; these multiple regions are designated 40*a* and 40*b*. Each region 40*a*, 40*b* has an associated discharge needle 42*a*, 42*b*, respectively.

With DC potentials applied to the discharge needle 42*a*, 42*b*; a planar laminated high-transmission element (as described in our U.S. Pat. No. 6,818,889) consisting of an inner high-transmission electrode or just inner-HT electrode 64*a*, 64*b* and an outer high-transmission electrode or just outer-HT electrode 66*a*, 66*b* populated with slotted openings (not shown); a funnel aperture wall 78; and a deep-well lens 72. Approximately all of the reagent ions generated in a reagent ion source region 44*a*, 44*b* take on a series of reagent ion trajectories 46*a*, 46*b* as they flow from regions 40*a*, 40*b*, through the inner- 64*a*, 64*b* and outer-HT electrodes 66*a*, 66*b* and into the product ion-sampling or funnel region 50; where the reagent ions undergo ion-molecule reactions with the sample, delivered to region 50 from source 10, to make gas-phase sample ions in sample ionization region 52*a*, 52*b*.

Under the influences of the applied DC potentials on the elements, walls, and lenses; approximately all of the gas-phase ions in region 50, including reagent and sample ions, take on a series of ions trajectories 56 and are focused through the funnel aperture 58 in the funnel aperture wall 78, into a deep-well region 70 through an exit aperture 76 in the deep-well lens 72 into the ion collection region 80. The deep-well lens 72 is isolated from the funnel aperture wall 78 by a deep-well insulator ring 74.

Aperture 76 has a diameter appropriate to restrict the flow of gas into region 80. In the case of vacuum detection, such as mass spectrometry in region 80, typical aperture diameters are 100 to 1000 micrometers. The collection region 80 in this embodiment is intended to be the vacuum system of a mass spectrometer (interface stages, optics, analyzer, detector) or other low-pressure ion and particle detectors.

Excess sample and reagent gases in region 50 are exhausted through a exhaust outlet 60 and delivered to an exhaust destination 62.

Figure 2:
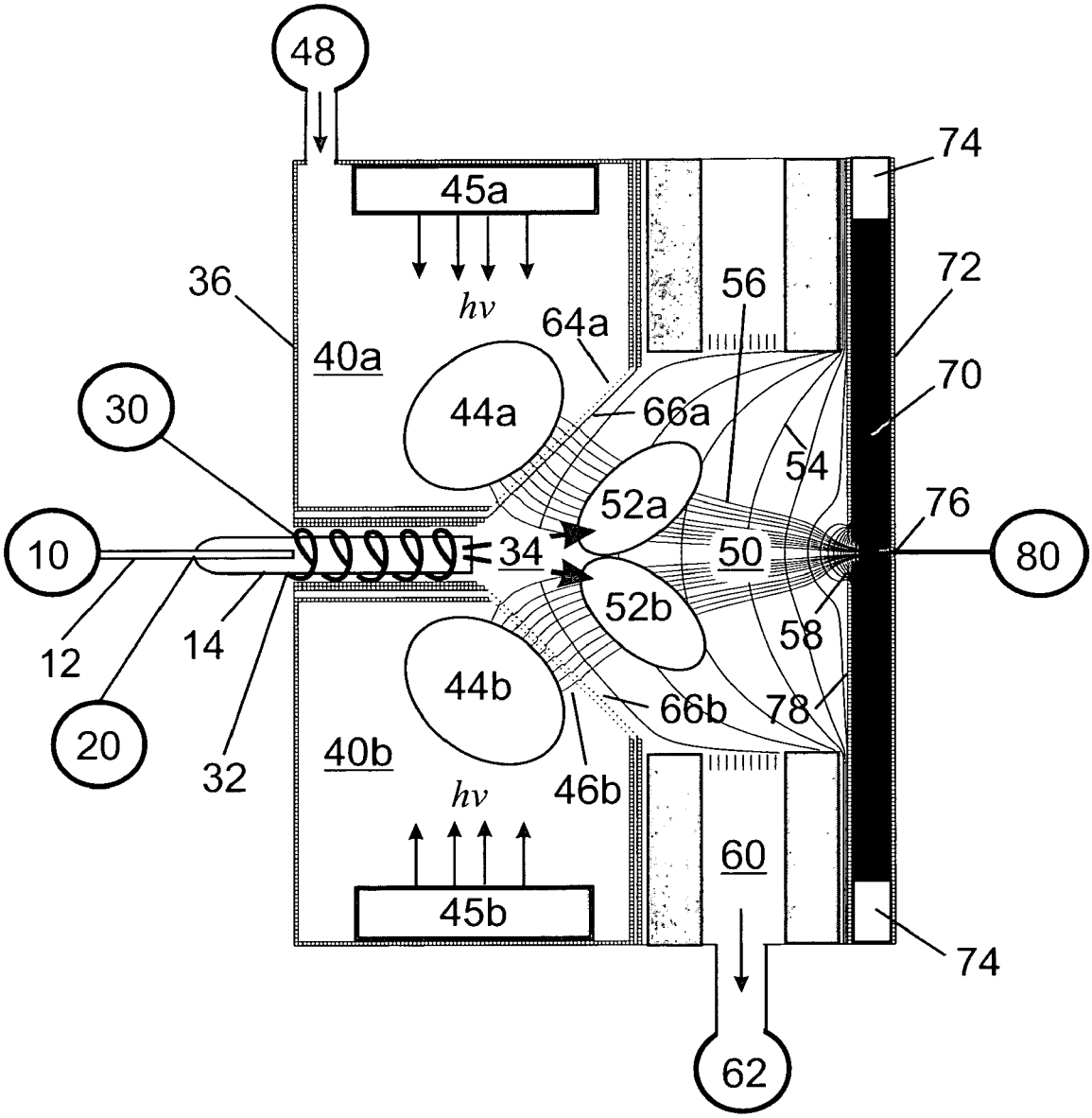
FIG. 2 is a cross-sectional illustration of a remote reagent ion generation source for atmospheric pressure photo-ionization (APPI).

Additional Embodiment—FIG. 2

(Remote Atmospheric Pressure Photo-ionization (Remote-APPI)

An additional embodiment is shown in FIG. 2; an atmospheric pressure chemical ionization source where photo-ionization is used to generate reagent ions. The only distinguishing component of this embodiment that varies from the previous embodiment shown in FIG. 1 is that the high voltage supply 41 and discharge needle 42 are replaced by a lamp 45 to supply photons required to facilitate photo-ionization in regions 40*a*, 40*b*. In this case, multiple lamps 45*a*, 45*b* are used to create photo-reagent ions in multiple source regions 44*a*, 44*b* located in the annular space around the sample ionization region 52*a*, 52*b*. Organic dopants, such as but limited to benzene, toluene, or acetone can be added to the reagent ionization region 40*a*, 40*b* from source 48 along with any other gases from source 48.

Figure 3:
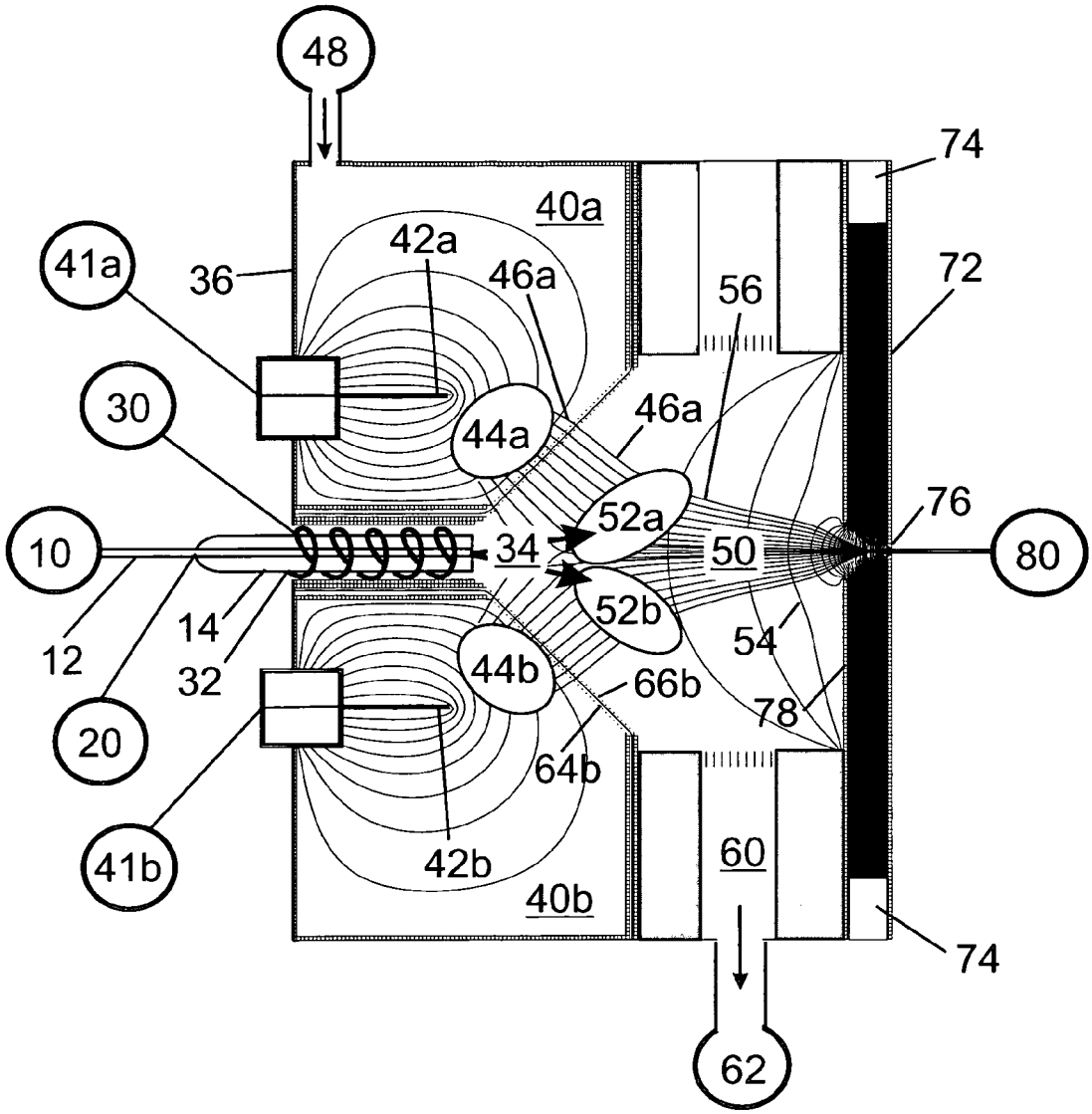
FIG. 3 is a cross-sectional illustration of a remote reagent ion generation source for a lower-pressure chemical ionization (CI) source.

Alternative Embodiment—FIG. 3

(Chemical Ionization and Thermospray)

There are various possibilities with regard to the type of sample and pressure regime at which the chemical ionization source is operated, as illustrated in FIG. 3. FIG. 3 shows a source, at atmospheric or less than atmospheric pressure, with the sample being delivered through the sample delivery line 12 is a gas, where the sample source 10 is a gas chromatograph, or is a liquid and the nebulizer 14 is a thermospray nebulizer where the sample source is a liquid chromatograph. Gases in the reaction region 50 are removed by a mechanical pump in gas destination 62 to maintain the reaction region at atmospheric or lower pressures.

Operation—FIGS. 1, 2, and 3

The manner of using the source to ionize gas-phase molecular species is similar to that for sources in present use. Namely, gas-phase reagent ions are generated in a region 40 adjacent to the sample ionization region 52, by means of a corona discharge, such as but not limited to atmospheric pressure ionization, atmospheric pressure chemical ionization, etc. Alternatively, reagent ions can also be formed by the process of photoionization, whereby the gas or gases in the reagent ion generation region 40 undergoes photoionization by light emitted from the lamp 45. Reagent ions in the region 44 are attracted to the laminated element (64, 66) by an electric potential difference between the source region 40 and the potential of the inner-HT electrode 64. The reagent ions moving toward the inner-HT electrode are diverted away from the conducting surface of electrode 64 and focused into the openings in the laminated high-transmission electrode (64, 65) due to the field lines emanating from the outer-HT electrode 66 through the openings into the reagent ion source region 44 causing approximately all of the ions to flow through the openings and out into the sample ionization region 52 as shown by the ion trajectories 46. The degree to which the field penetrates into region 44 is due to the potential difference between the inner- and outer-HT electrode 64, 66, respectively, being relatively high.

The sample, composed of neutral or ionic aerosols or both, is introduced into the reaction region 52 where the components of the sample interact with the reagent ions moving through this region, forming ionic species from the sample components. New ionic species formed from the interaction of reagent ions and sample aerosol and any other remaining ionic species in regions 50, 52 are accelerated away from the funnel region 50 and focused through the funnel aperture 58 into the deep-well region 70 where a well collimated and highly compressed beam of ions is delivered to the exit aperture 76 for transfer into the ion collection region 80 where the collection region is the vacuum system of a mass spectrometer or any other low-pressure ion or particle detector.

Gases from the reagent ion generation region 40 that have passed through the laminated high-transmission element and gases from the sample source 10 that have flowed into region 50 are at least partially removed from the funnel region through the exhaust outlet 60.

FIG. 3 shows a source where the sample is introduced by spraying a liquid by means of a thermospray nebulizer or alternatively a gas from a gas chromatograph. A mechanical vacuum pump in the exhaust destination 62 maintains the pressure in the reaction region 50 to as low as 100 millitorr. In this pressure regime (typically in the 10 torr range) care must be taken to avoid discharge from occurring in region 50.

CONCLUSION RAMIFICATIONS, AND SCOPE

Although the description above contains many specifications, these should not be construed as limiting the scope of the invention but as merely providing illustrations of some of the presently preferred embodiments of this invention. For example the sample can be introduced off-axis or orthogonal to the funnel region; gases and gas mixtures such as helium, nitrogen by be added to the ionization region to formed specified reagent ions; direct current (DC), radio-frequency (RF) reagent ion sources, or combinations thereof may be used for the generation of reagent ions; the laminated high-transmission element can have other shapes, such as spherical, conical shaped; the number of laminates of the laminated high-transmission elements can vary depending on the source of ions, the type of ion-collection region or a combination of both; the device may be self-contained (ion source, power supplies, computer, gases, and ion analyzer) small enough to be placed on a small table or workbench or mounted on wall in a building or the device may be packaged as a probe (ion source, power connections, inlets for gases) design to be added to existing mass spectrometers and ion mobility analyzers, etc.

Thus the scope of the invention should be determined by the appended claims and their legal equivalents, rather than by the examples given.

We claim:

1. A chemical ionization apparatus for the collection and focusing of gas-phase ions produced from chemical species, the apparatus comprising:

a. a dispersive source of gas-phase reagent ions operated substantially at atmospheric pressure;

b. a sample introduction means operated substantially at atmospheric pressure, wherein said means is a heated conduit for the introduction of said chemical species as gaseous substances or an aerosol;

c. a reaction region receiving the outlets of said sample introduction means and said reagent ion source, which are arranged so that said gaseous substances emitted from said sample introduction means and said reagent ions from said reagent ion source interact forming gas-phase ionic chemical species;

d. an analyzer chamber exposed to a high vacuum downstream of said reaction region, for receiving said gas-phase reagent ions and ionic chemical species, said analyzer chamber being occupied by a mass spectrometer and associated transfer ion optics and radio frequency (RF) multi-pole devices, an ion mobility analyzer, and combinations thereof;

e. a first laminated lens sandwiched between said reagent ion source and reaction region, said lens populated with a plurality of openings through which said gas-phase reagent ions pass unobstructed into said reaction region, said lens consisting of an insulating body of material, said insulating body having a topside and an underside, said insulating body has a layer of metal laminated on said topside and said underside that are contiguous with said insulating body, said metal laminate on said topside of said insulating body is adjacent to said reagent ion source, said metal laminate on said underside of said insulating body is adjacent to said reaction region, said openings having a low depth aspect ratio, a high openness aspect ratio, said metal laminates being supplied with attracting electrostatic potentials by connection to a voltage supply for generating a large electrostatic potential ratio between said laminates and establishing an electrostatic field between said source of reagent ions and said metal laminates; and f. a second laminated lens sandwiched between said reaction region and said analyzer chamber, said second laminated lens having a central opening through which substantially all said gas-phase ions pass unobstructed into said analyzer chamber, said second laminated lens consisting of a second insulating body of material, said second insulating body having a topside and an underside, said second insulating body has a second set of metal laminated on said topside and said underside that are contiguous with said second insulating body, said metal laminate on said topside of said second insulating body is adjacent to said reaction region, said metal laminate on said underside of said second insulating body is adjacent to said analyzer chamber forming a deep-well region between said metal laminates of second laminated lens, said second set of metal laminates being supplied with attracting electrostatic potentials by connection to a voltage supply, and generating an electrostatic field between said reaction region and said second set of metal laminates;

wherein said region of reagent ion generation is physically separated from said ion reaction region.

2. A method for producing gas-phase ions from an atmospheric pressure chemical ionization apparatus, said method comprising:

a. forming gas-phase reagent ions in a dispersive source operated substantially at atmospheric pressure, said gas-phase reagent ions being formed by a direct or alternating electrical current discharge in a gas, photoionization of gases, a gas discharge in a magnetic field, bombardment of metals or salts by high energy ions, inductively coupled plasma, and combinations thereof;

b. providing electrostatic attraction to said gas-phase reagent ions with electrostatic fields provided by a laminated lens, said laminated lens having an ion drawing potential, such that electrostatic field lines between said source of reagent ions and metal laminates on the topside and underside of said laminated lens are concentrated on said metal laminate on said top side of said laminated lens;

c. transmitting substantially all said gas-phase reagent ions through said laminated lens allowing the unobstructed passage of said reagent ions and reagent gas by providing a plurality of holes in said laminated lens with a low depth aspect ratio, a high openness aspect ratio, and a high electrostatic potential ratio between said metal laminates on the topside and underside of said laminated lens;

d. supplying a gaseous, liquid, or solid sample containing molecules to a heated sample introduction means at substantially atmospheric pressure for emitting molecules in said sample as gas-phase molecules; and e. receiving said gas-phase molecules from said introduction means and said gas-phase reagent ions from said reagent ion source in a reaction region at substantially atmospheric pressure where said gas-phase molecules react with said reagent ions forming gas-phase ionic chemical species.

3. A method for producing gas-phase ions from an atmospheric pressure chemical ionization apparatus as claimed in claim 2, which further includes the step of providing an electrostatic attraction to said gas-phase ions in said reaction region with an electrostatic field generated by a second laminated lens, said second laminated lens having an ion-drawing potential such that electrostatic field lines between said reaction region and metal laminates on the topside and underside of said second laminated lens are concentrated into a plurality of openings in said second laminated lens urging said gas-phase ions in said reaction region to be directed towards and through said openings whereby substantially all said gas-phase ions flow into a analyzer chamber.

4. A method for producing gas-phase ions from an atmospheric pressure chemical ionization apparatus as claimed in claim 3, which further includes an aperture or capillary tube leading into a mass spectrometer, an ion mobility analyzer, or combination thereof in said analyzer chamber for detecting said gas-phase ions.

5. A chemical ionization apparatus for the collection and focusing of gas-phase ions produced from chemical species, the apparatus comprising:

a. a dispersive source of gas-phase reagent ions operated substantially at atmospheric pressure, said gas-phase reagent ions being formed by direct current or alternating current electrical discharge ionization and combinations thereof;

b. a sample introduction means operated substantially at atmospheric pressure, wherein said means is a heated conduit for the introduction of said chemical species as gaseous substances or an aerosol;

c. a reaction region receiving the outlets of said sample introduction means and said reagent ion source, which are arranged so that said gaseous substances emitted from said sample introduction means and said gas-phase reagent ions from said reagent ion source interact forming gas-phase ionic chemical species;

d. an analyzer chamber exposed to a high vacuum downstream of said reaction region, for receiving said gas-phase reagent ions and ionic chemical species;

e. a first laminated lens sandwiched between said reagent ion source and reaction region, said lens populated with a plurality of openings through which said gas-phase reagent ions pass unobstructed into said reaction region, said lens consisting of an insulating body of material, said insulating body having a topside and an underside, said insulating body has a layer of metal laminated on said topside and said underside that are contiguous with said insulating body, said metal laminate on said topside of said insulating body is adjacent to said reagent ion source, said metal laminate on said underside of said insulating body is adjacent to said reaction region, said openings having a low depth aspect ratio, a high openness aspect ratio, said metal laminates being supplied with attracting electrostatic potentials by connection to a voltage supply for generating a large electrostatic potential ratio between said laminates and establishing an electrostatic field between said source of reagent ions and said metal laminates; and f. a second laminated lens sandwiched between said reaction region and said analyzer chamber, said second laminated lens having a central opening through which substantially all said gas-phase ions and ionic species pass unobstructed into said analyzer chamber, said second laminated lens consisting of a second insulating body of material, said second insulating body having a topside and an underside, said second insulating body has a second set of metal laminated on said topside and said underside that are contiguous with said second insulating body, said metal laminate on said topside of said second insulating body is adjacent to said reaction region, said metal laminate on said underside of said second insulating body is adjacent to said analyzer chamber forming a deep-well region between said metal laminates of second laminated lens, said second set of metal laminates being supplied with attracting electrostatic potentials by connection to a voltage supply, and generating an electrostatic field between said reaction region and said second set of metal laminates;

wherein said region of reagent ion generation is physically separated from ion reaction region.

6. A chemical ionization apparatus for the collection and focusing of gas-phase ions produced from chemical species, the apparatus comprising:

a. a dispersive source of gas-phase reagent ions operated substantially at atmospheric pressure;

b. a sample introduction means operated substantially at atmospheric pressure, wherein said means is a heated conduit for the introduction of said chemical species as a gas that comprises non-ionic or neutral gaseous chemical species, an aerosol, and combinations thereof;

c. a reaction region receiving the outlets of said sample introduction means and said reagent ion source, which are arranged so that said gaseous substances emitted from said sample introduction means and said reagent ions from said reagent ion source interact forming gas-phase ionic chemical species;

d. an analyzer chamber exposed to a high vacuum downstream of said reaction region, for receiving said gas-phase reagent ions and ionic chemical species;

e. a first laminated lens sandwiched between said reagent ion source and reaction region, said lens populated with a plurality of openings through which said gas-phase reagent ions pass unobstructed into said reaction region, said lens consisting of an insulating body of material, said insulating body having a topside and an underside, said insulating body has a layer of metal laminated on said topside and said underside that are contiguous with said insulating body, said metal laminate on said topside of said insulating body is adjacent to said reagent ion source, said metal laminate on said underside of said insulating body is adjacent to said reaction region, said openings having a low depth aspect ratio, a high openness aspect ratio, said metal laminates being supplied with attracting electrostatic potentials by connection to a voltage supply for generating a large electrostatic potential ratio between said laminates and establishing an electrostatic field between said source of reagent ions and said metal laminates; and f. a second laminated lens sandwiched between said reaction region and said analyzer chamber, said second laminated lens having a central opening through which substantially all said gas-phase ions pass unobstructed into said analyzer chamber, said second laminated lens consisting of a second insulating body of material, said second insulating body having a topside and an underside, said second insulating body has a second set of metal laminated on said topside and said underside that are contiguous with said second insulating body, said metal laminate on said topside of said second insulating body is adjacent to said reaction region, said metal laminate on said underside of said second insulating body is adjacent to said analyzer chamber forming a deep-well region between said metal laminates of second laminated lens, said second set of metal laminates being supplied with attracting electrostatic potentials by connection to a voltage supply, and generating an electrostatic field between said reaction region and said second set of metal laminates;

wherein said region of reagent ion generation is physically separated from said ion reaction region.

7. A chemical ionization apparatus for the collection and focusing of gas-phase ions produced from chemical species, the apparatus comprising:

a. a dispersive source of gas-phase reagent ions operated substantially at atmospheric pressure;

b. a sample introduction means operated substantially at atmospheric pressure, wherein said means includes a heated conduit for the introduction of said chemical species and provides a solid sample whereby said solid sample is vaporized by heating a probe which said sample is placed on, irradiating said sample with light, passing a heated gas over said sample, and combinations thereof;

c. a reaction region receiving the outlets of said sample introduction means and said reagent ion source, which are arranged so that said gaseous substances emitted from said sample introduction means and said reagent ions from said reagent ion source interact forming gas-phase ionic chemical species;

d. an analyzer chamber exposed to a high vacuum downstream of said reaction region, for receiving said gas-phase reagent ions and ionic chemical species;

e. a first laminated lens sandwiched between said reagent ion source and reaction region, said lens populated with a plurality of openings through which said gas-phase reagent ions pass unobstructed into said reaction region, said lens consisting of an insulating body of material, said insulating body having a topside and an underside, said insulating body has a layer of metal laminated on said topside and said underside that are contiguous with said insulating body, said metal laminate on said topside of said insulating body is adjacent to said reagent ion source, said metal laminate on said underside of said insulating body is adjacent to said reaction region, said openings having a low depth aspect ratio, a high openness aspect ratio, said metal laminates being supplied with attracting electrostatic potentials by connection to a voltage supply for generating a large electrostatic potential ratio between said laminates and establishing an electrostatic field between said source of reagent ions and said metal laminates; and f. a second laminated lens sandwiched between said reaction region and said analyzer chamber, said second laminated lens having a central opening through which substantially all said gas-phase ions pass unobstructed into said analyzer chamber, said second laminated lens consisting of a second insulating body of material, said second insulating body having a topside and an underside, said second insulating body has a second set of metal laminated on said topside and said underside that are contiguous with said second insulating body, said metal laminate on said topside of said second insulating body is adjacent to said reaction region, said metal laminate on said underside of said second insulating body is adjacent to said analyzer chamber forming a deep-well region between said metal laminates of second laminated lens, said second set of metal laminates being supplied with attracting electrostatic potentials by connection to a voltage supply, and generating an electrostatic field between said reaction region and said second set of metal laminates;

wherein said region of reagent ion generation is physically separated from said ion reaction region.

8. A remote reagent ionization apparatus for the production of sample ions, charged particles, or ionic species produced from sample species, the apparatus comprising:

a. a remote ion source region operated substantially at or above atmospheric pressure producing reactant species remotely from a sample reaction region;

b. said sample reaction region receiving the outlet of said ion source region, said reactant species reacting with said sample species in said reaction region; and c. a perforated electrically conductive barrier, wherein said barrier is located between said ion source and reaction regions; through which the said reactant species travel from said ion source region to said reaction region, whereby said sample product ions, charged particles, or ionic species are collected or analyzed.

9. A remote reagent ionization apparatus for the production of ionic species produced from sample species, as defined in claim 8, wherein said remote ion source region is comprised of a discharge source whereby gas-phase reactant species are formed.

10. A remote reagent ionization apparatus for the production of ionic species produced from sample species, as defined in claim 8, wherein said remote ion source region is comprised of a photoionization source.

11. A remote reagent ionization apparatus for the production of ionic species produced from sample species, as defined in claim 8, wherein said remote ion source region is comprised of more than one remote ionization region positioned relative to said sample reaction region, each of said multiple ion source regions being separated from said sample reaction region by one or more said perforated electrically conducting barriers.

12. A remote reagent ionization apparatus for the production of ionic species produced from sample species, as defined in claim 8, wherein said remote ion source region is supplied with a specific reagent gas or gases to facilitate production of said reactant species that yield desired or predictable said sample ions, charged particle, or ionic species in said sample reaction source region.

13. A remote reagent ionization apparatus for the production of ionic species produced from sample species, as defined in claim 8, wherein said perforated electrically conductive barrier is comprised of a perforated surface such as a perforated metal, a perforated metal with a plurality of holes or openings, a perforated laminated structure comprised of metal and insulating laminates, or a perforated laminated structure comprised of metal and insulting laminates with a plurality of holes.

14. A remote reagent ionization apparatus for the production of ionic species produced from sample species, as defined in claim 8, wherein said sample is comprised of neutral gas-phase sample species such as eluent from gas chromatograms.

15. A remote reagent ionization apparatus for the production of ionic species produced from sample species, as defined in claim 8, wherein said sample is comprised of neutral aerosol sample species such as naturally occurring or environmental aerosols, resulting from aerosol generators and sprayers, and process aerosol streams.

16. A remote reagent ionization apparatus for the production of ionic species produced from sample species, as defined in claim 8, wherein said sample product ions are comprised of charged gas-phase ions.

17. A remote reagent ionization apparatus for the production of ionic species produced from sample species, as defined in claim 8, wherein said sample product charged particles are comprised of charged gas-phase particles.

18. A remote reagent ionization apparatus for the production of ionic species produced from sample species, as defined in claim 8, wherein said analysis of sample product ions is comprised of gas-phase ion detectors such as a mass spectrometer, an ion mobility spectrometer, other low-pressure ion or particle detectors, and combinations thereof.

19. A remote reagent ionization apparatus for the production of ionic species produced from sample species, as defined in claim 8, wherein said collection of sample product ions, charged particles, or ionic species is comprised of a collection means such as surface deposition, trapping, precipitation, and filtering.

20. An atmospheric pressure ionization apparatus for the production of ionic species produced from sample species, as defined in claim 8, wherein said reactant species comprise products of electrical discharge processes.

21. An atmospheric pressure ionization apparatus for the production of ionic species produced from sample species, as defined in claim 8, wherein said reactant species pass through, or are gated or pulsed through said barrier.

22. An atmospheric pressure ionization apparatus for the production of ionic species produced from sample species, as defined in claim 8, wherein said conductive barrier is geometrically sized to isolate the electrostatic fields of said ion source from said reaction region.

23. An atmospheric pressure ionization apparatus for the production of ionic species produced from sample species, as defined in claim 8, wherein said conductive barrier has at least one opening, such as a perforated lens; a grid; a laminated structure with a least two openings; a laminated structure with a plurality of openings; or a many layer high-transmission surface with a plurality of openings, said opening(s) providing a pathway for passage of said reactant species from said ion source region to said reaction region.

24. An atmospheric pressure ionization apparatus for the production of ionic species produced from sample species, as defined in claim 8, wherein said reaction region receives the outlet of said ion source by means of gas flowing from said ion source through said barrier into said reaction region.

25. An atmospheric pressure ionization apparatus for the production of ionic species produced from sample species, as defined in claim 8, further comprising a sample introduction means operated substantially at atmospheric pressure, said introduction means comprising a heated conduit for the introduction of said sample species as gaseous substances, an aerosol comprised of gas-phase species, liquid droplets, and combinations thereof.

26. An atmospheric pressure ionization apparatus for the production of ionic species produced from sample species, as defined in claim 25, wherein said sample introduction means is disposed coaxially with said electrically conductive barrier, whereby substantially all said reactant species interact with said gaseous substances emitted from said sample introduction means in said reaction region.

27. An atmospheric pressure ionization apparatus for the production of ionic species particles produced from sample species, as defined in claim 25, wherein said sample introduction means provides a gas, said gas comprising non-ionic or neutral gaseous chemical species, an aerosol of neutral, ionic species, or charged droplets, or combinations thereof.

28. An atmospheric pressure ionization apparatus for the production of ionic species produced from sample species, as defined in claim 25 wherein said sample introduction means comprises the outlet of a liquid chromatograph.

29. An atmospheric pressure ionization apparatus for the production of ionic species produced from sample species, as defined in claim 25, wherein said sample introduction means comprises a thermospray nebulizer maintained at or below atmospheric pressure for vaporizing a solution containing a solvent and molecule(s) of interest for detection or analysis.

30. An atmospheric pressure ionization apparatus for the production of ionic species produced from sample species, as defined in claim 25, wherein said sample introduction means is comprised of a thermal pneumatic nebulizer for vaporizing a solution containing a solvent and molecule(s) of interest for detection or analysis.

31. An atmospheric pressure ionization apparatus for the production of ionic species produced from sample species, as defined in claim 8, further comprising:

a. an exhaust outlet downstream of said reaction region for evacuating said reaction region; and b. a valve means for controlling the inflow and out-flow of gas into and out of said reaction region;

whereby pressure within said reaction region is maintained at, near, or below atmospheric pressure.

32. An atmospheric pressure ionization apparatus for the production of ionic species produced from sample species, as defined in claim 8, further including an analyzer comprising a mass spectrometer or other low-pressure ion or particle detector.

33. An atmospheric pressure ionization apparatus for the production of ionic species produced from sample species, as defined in claim 8, further including an atmospheric interface for a mass spectrometer said interface comprising an aperture; a capillary tube; an array of capillaries; or a laminated structure comprised of a plurality of openings and alternating layers of insulating and metallic material; associated transfer optics; radio frequency (RF) multi-pole devices; and vacuum components.

34. A method for atmospheric pressure production of sample ions or charged particles with remote reagent ionization, the method comprising:

a. generating reactant species in a remote ion source region operated substantially at or above atmospheric pressure;

b. transferring reactant species from said remote ion source region across a perforated electrically conducting barrier to a sample reaction region; and c. reacting said reactant species in said sample reaction region with sample species to produce said sample product ions or charged particles;

whereby said sample product ions or charged particles are collected or analyzed.

35. A method for atmospheric pressure production of sample ions or charged particles with remote reagent ionization, as defined in claim 34, further including the step of focusing said sample product ions or charged particles away from said sample reaction region toward a collector or analyzer.

36. A method for atmospheric pressure production of sample ions or charged particles with remote reagent ionization, as claimed in claim 34, further including analyzing said sample product ions or charged particles using a low-pressure ion or particle detector.

37. A method for creating analyte ions at or near atmospheric pressure, the method comprising:

a. causing the production of reactant species from a reagent gas or gases;

b. transporting said reactant species to a remote reaction region through a barrier; and c. reacting said reactant species with an analyte in said reaction region;

whereby said reaction results in the production of said analyte ions.

38. A method for creating analyte ions at or near atmospheric pressure, as defined in claim 37, where said reactant species are gas-phase ionic species and which further comprises providing an electrostatic attraction to said analyte ions and any residual said ionic species in said reaction region by applying an electrostatic field generated by a high-transmission lens whereby electrostatic field lines between said reaction region and said high-transmission lens are concentrated into a plurality of openings in said high-transmission lens, thereby urging said analyte ions and any residual said ionic species in said recation region toward and through said openings and causing substantially all said analyte ions and said residual ionic species in said reaction region to flow into an analyzer chamber.

39. A method for creating analyte ions at or near atmospheric pressure, as defined in claim 37, which further includes analyzing said analyte ions using mass spectrometry, ion mobility spectrometry, other low-pressure ion or particle detectors, and combinations thereof.

40. A method for creating analyte ions at or near atmospheric pressure, as claimed in claim 37, wherein said reactant species are produced by direct or alternating electrical current discharge of a gas, photoionization of gases, a gas discharge in a magnetic field, electrospray, and combinations thereof.

* * * * *